US005318305A

United States Patent [19]

LoCoco

[11] Patent Number: 5,318,305

[45] Date of Patent: Jun. 7, 1994

[54] BOARD GAME

[76] Inventor: Cecile A. LoCoco, 8208 Huntly La., Harahan, La. 70123

[21] Appl. No.: 63,945

[22] Filed: May 19, 1993

[51] Int. Cl.[5] ..... A63F 3/00

[52] U.S. Cl. ..... 273/258; 273/290

[58] Field of Search ..... 273/258, 260, 248, 290, 273/242

[56] References Cited

U.S. PATENT DOCUMENTS 2,610,060 9/1952 Powell ..... 273/260
3,863,927 2/1975 Moritz ..... 273/258
4,613,134 9/1986 Tobin ..... 273/258
5,018,744 5/1991 Patracuolia ..... 273/260

*Primary Examiner*—Benjamin H. Layno
*Attorney, Agent, or Firm*—George A. Bode; Michael L. Hoelter

[57] ABSTRACT

A two person board game incorporating playing pieces that are movable about the board in a forward, backward or sideways direction as desired. These playing pieces may be stacked or unstacked as desired to achieve the intended purpose which is primarily to cause certain marked playing pieces to land upon certain marked safety zones and secondarily to capture the playing pieces of the opposing player.

13 Claims, 12 Drawing Sheets

BOARD GAME

BACKGROUND OF THE INVENTION

1. Field of the Invention

This invention pertains to a board game and more particularly to a two-person board game involving movable pieces the object of which is to relocate certain designated pieces onto certain marked spaces of the board before these pieces are captured by the other player.

2. General Background

Board games such as chess and checkers have been played for many years, if not centuries, virtually without change. These games provide for movable pieces that are only permitted to move in a preset direction and only along a known path, no variation is permitted.

Other board games have been developed which more directly introduce the concept of "war" into play such as by using pieces configured as battlefield implements or by moving the pieces over a graphic representation of a battlefield. In either event, the players can often become more concerned with an individual skirmish rather than with the overall concept or strategy of winning the game.

Board games have also been introduced which have three dimensions of movement, i.e. forward and backward, sideways, and up and down. The addition of this third dimension (usually up and down) rapidly complicates the play and makes the strategy involved more complex.

Some board games also attempt to foster the educational development of the players by requiring them to abstractly consider not only the current move, but also future moves. This is more easily accomplished when the individual moves are not randomly selected, such as by rolling dice or spinning a wheel, but instead must be well thought out since the players take turns moving at their discretion.

It is an object of the present invention to provide a new type of board game that involves the movement of pieces around a board with the object being to land certain such pieces upon certain marked spaces.

Another object of this invention is to provide for the movement of such pieces which is dependent upon the value of the piece, thereby reducing the element of randomness or luck and increasing the need for strategy to win.

yet another object of this invention is to provide for the "stacking" and "unstacking" of pieces upon one another so as to vary the movement of the pieces involved during play.

Still another object of this invention is to encourage the players to analyze their moves in order to set up their future moves, rather than relying upon a wheel or die to inform them of the move permitted.

Furthermore, it is an object of this invention to provide for some inherent difficulty in accomplishing the task at hand so as to enhance the skill level of the players. These and other objects and advantages of this invention will become obvious upon further investigation.

SUMMARY OF THE PRESENT INVENTION

The preferred embodiment of the apparatus of the present invention solves the aforementioned problems in a straightforward and simple manner. What is provided is a board game that incorporates a flat, generally rectangular game board having a grid of orthogonal lines thereon. These orthogonal lines define a series of adjacent rows and columns each of which consist of a plurality of individual spaces. This game board contains a series of marked or shaded safety zones thereon with each of these safety zone having a particular value assigned thereto. An equal number of safety zones are associated with each player with the safety zones associated with one player being shaded or marked differently from the safety zones associated with the other player. Additionally, each player is provided with multiple playing pieces that are marked or shaded so as to distinguish those of one player from those of another player. These playing pieces are also marked or shaded similarly to the safety zones of that player with each of these playing pieces also being assigned a value identical to one of the values assigned to that players' safety zones.

During play, the players take turns moving the playing pieces about the game bound only that number of spaces identical with the value assigned thereto. These playing pieces also can only be moved in a forward, backward, or sideways direction. Additionally, playing pieces of a similar marking or shading are stackable one upon another, with such movement being referred to as "stacking" or "stacked". This stacked playing piece now has a value equal to the sum of the values of the individual playing pieces stacked together, and consequently, this stacked playing piece is now movable about the game board this new value. Furthermore, the stacked playing pieces may be selectively unstacked as needed by removing, from the top, as many of the previously stacked playing pieces as desired. This movement is referred to as "unstacking" or "unstacked", with the unstacked playing pieces now being movable about the game board a number of spaces equal to the sum of the individual values of the unstacked playing pieces.

Also during play, a playing piece of one player, whether stacked or unstacked, is movable onto the same space currently occupied by a playing piece of another player, whether stacked or unstacked. When this occurs, the last arriving playing piece "captures" the first arriving playing piece and removes this first arriving playing piece from further play. To "win", a player must be the first to move one or more of his/her playing pieces onto each of the safety zones associated with that player, these safety zones only permit the movement thereon of playing pieces having both the same shading or marking and the same value.

BRIEF DESCRIPTION OF THE DRAWING

For a further understanding of the nature and objects of the present invention, reference should be had to the following description taken in conjunction with the accompanying drawing in which like parts are given like reference numerals and, wherein:

FIG. 3 illustrates certain limitations of movement for these playing pieces;

FIG. 4 illustrates certain limitations of movement for this playing piece.

DETAILED DESCRIPTION OF THE PREFERRED EMBODIMENT

Figure 1:
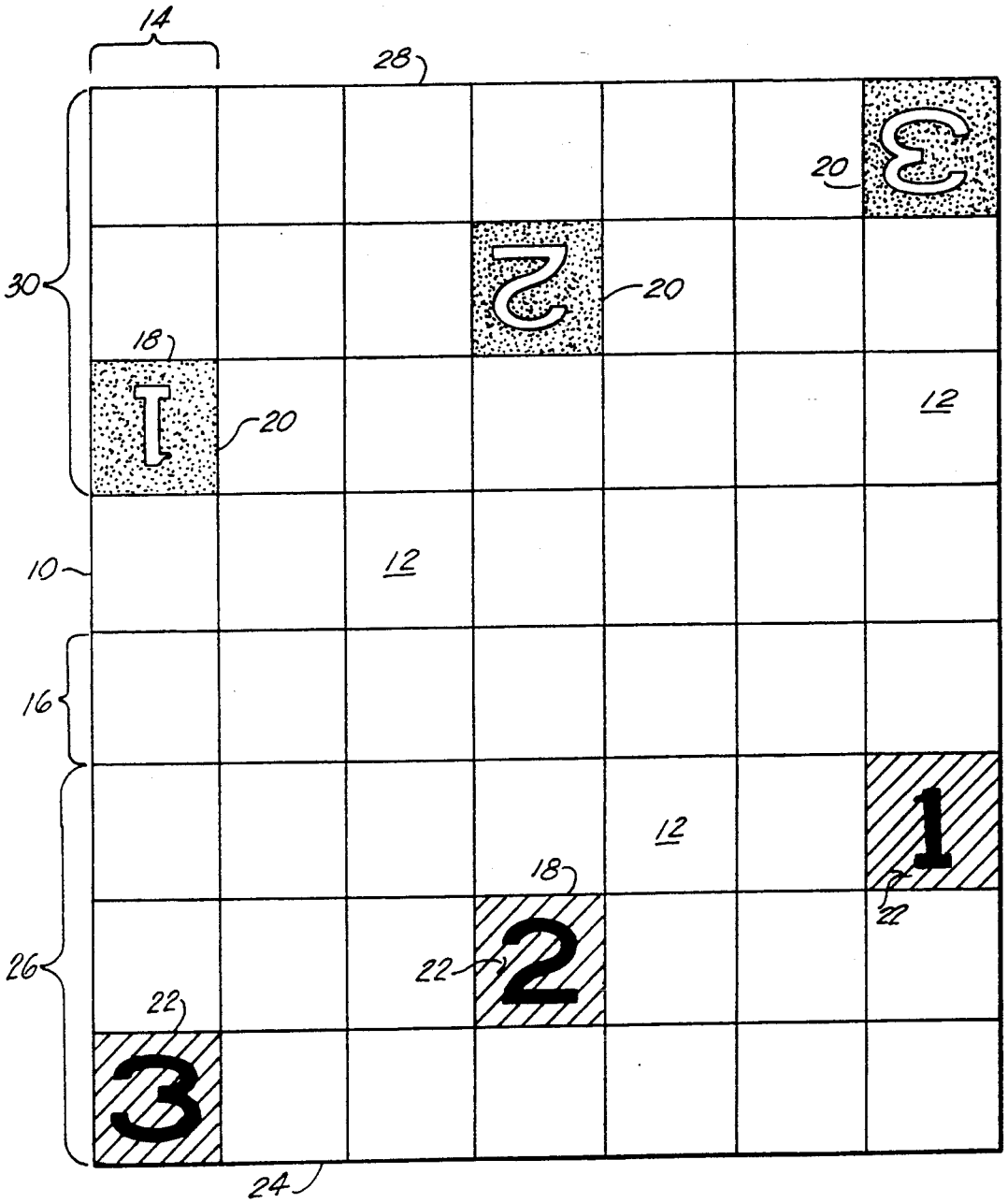
FIG. 1 is a plan view of the playing board of the invention illustrating the "safety zones" for each of the players.

Referring initially to FIG. 1, there is shown rectangular game board 10 which is divided into a series of equal spaces 12. In the preferred embodiment, board 10 is configured with seven columns 14 of eight spaces 12 each or eight rows 16 of seven spaces 12 each.

Also in this embodiment and as shown in FIG. 1, board 10 contains six shaded or pre-marked safety zones 18. A first set of three would be shaded in a first color or with a first marking 20 while a second set of three would be shaded in a second color or with a second marking 22. The first set 20 is associated with a first player while the second set 22 is associated with a second player.

Of these colored or marked safety zones 18, one from each set 20 and 22 is assigned a first value "A" (in this embodiment, value "A" is set to "1"), a second safety zone 18 from each of set 20 and 22 is assigned a second value "B" (in this embodiment, value "B" is set to "2"), while the remaining or third safety zone 18 from each of set 20 and 22 is assigned a third value of "C" (in this embodiment, value "C" is set to "3"). Preferably, the location and/or number of these specially marked or shaded safety zones 18 would be as shown, however, other locations or frequency of these safety zones 18 upon board 10 is equally likely if so desired. By this configuration of board 10, one end 24 is deemed the home region 26 of the first player while the opposite end 28 of board 10 is deemed the home region 30 of the second player.

Figure 2:
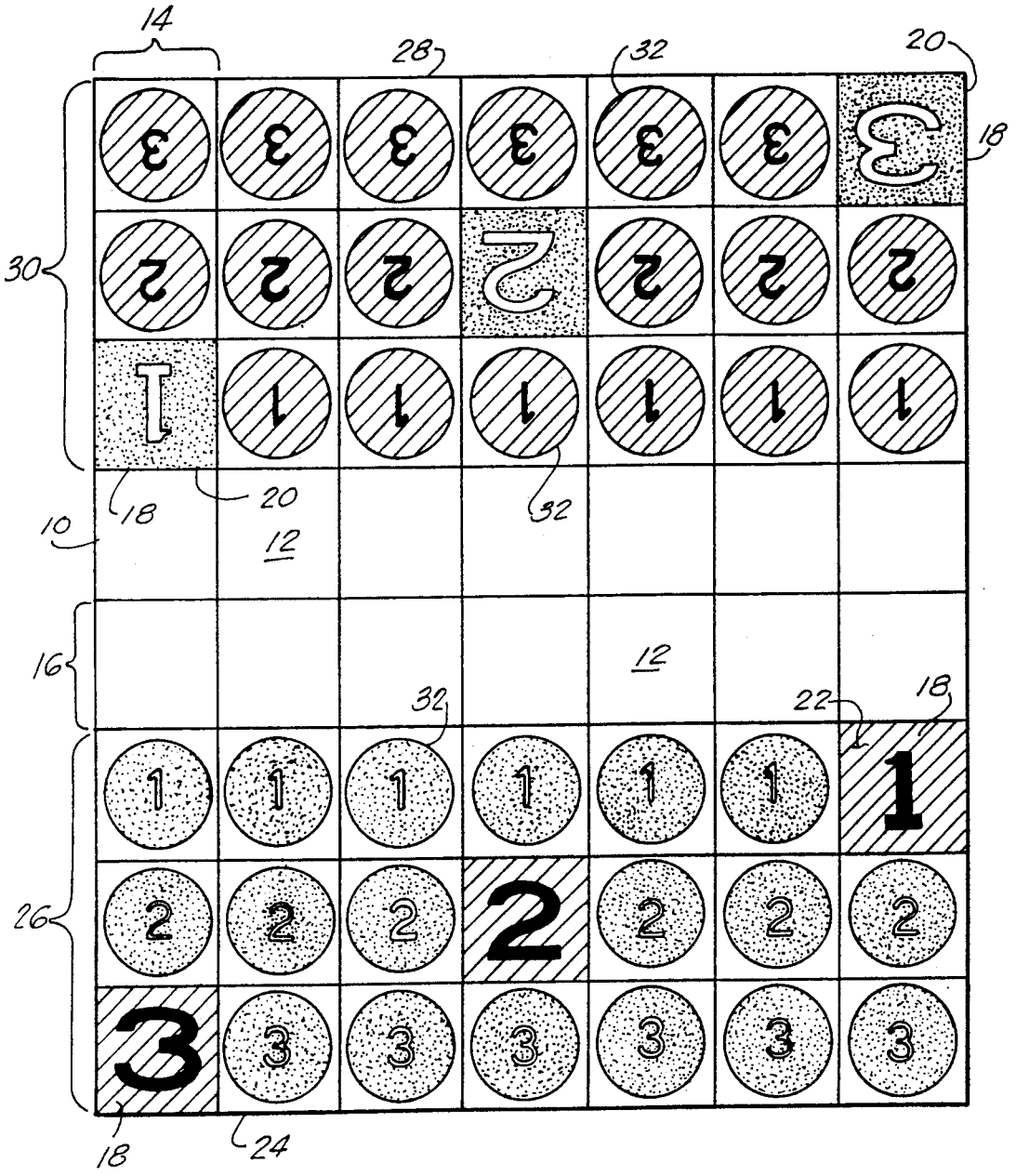
FIG. 2 is a plan view of the playing board of the invention with all the playing pieces properly located at the beginning of play.
Figure 5:
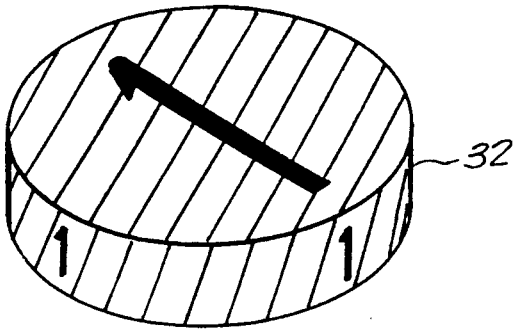
FIGS. 5-7 illustrate the various playing pieces involved in this invention.
Figure 7:
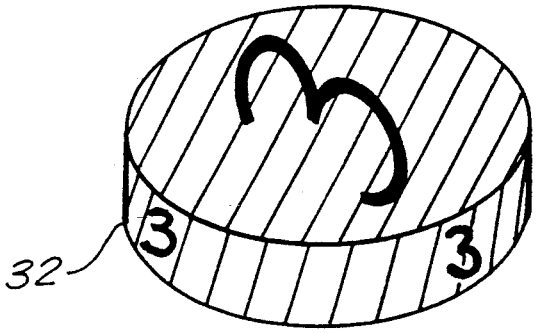
Figure 6:
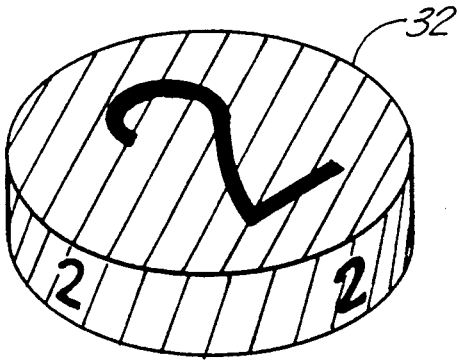

FIG. 2 illustrates the intended location of playing pieces 32 in their respective home regions 26 and 30 upon board 10 at the beginning of play. In this embodiment, each player is provided with eighteen playing pieces 32 which are colored or shaded so as to easily distinguish the playing pieces 32 of the first player from the playing pieces 32 of the second player. From each set of eighteen playing pieces 32, six are marked with a value of "A", six are marked with a value of "B", and six are marked with a value of "C" (these values corresponding to the values of "A", "B", and "C" assigned to safety zones 18 and in this embodiment are set to "1", "2", and "3"). See also FIGS. 5-7. Other values of "A", "B", and "C" are also likely, additionally, one or more of these values may be the same if so desired.

As shown in FIG. 2, each of playing pieces 32 having the same value are placed within the same row 16. However, no playing piece 32 is placed upon any of the shaded or premarked safety zones 18. Also in this embodiment, the playing pieces 32 with the highest value ("C") are placed adjacent end 24 or 28 of game board 10, with the next highest value ("B") of playing pieces 32 being spaced in the next row 16 and with the lowest value ("A") of playing pieces 32 being placed in the next adjacent row 16. Thus, before play begins, all of playing pieces 32 are located as shown in FIG. 2.

While the players themselves can determine who is to move first, lacking such an agreement, the player having the darker playing pieces 32 can make the first move. Each player moves as explained below, one move per play, with play alternating between the players, in turn, until a player places one or more of his/her playing pieces 32 upon each of his/her associated safety zones 18.

Figure 3:
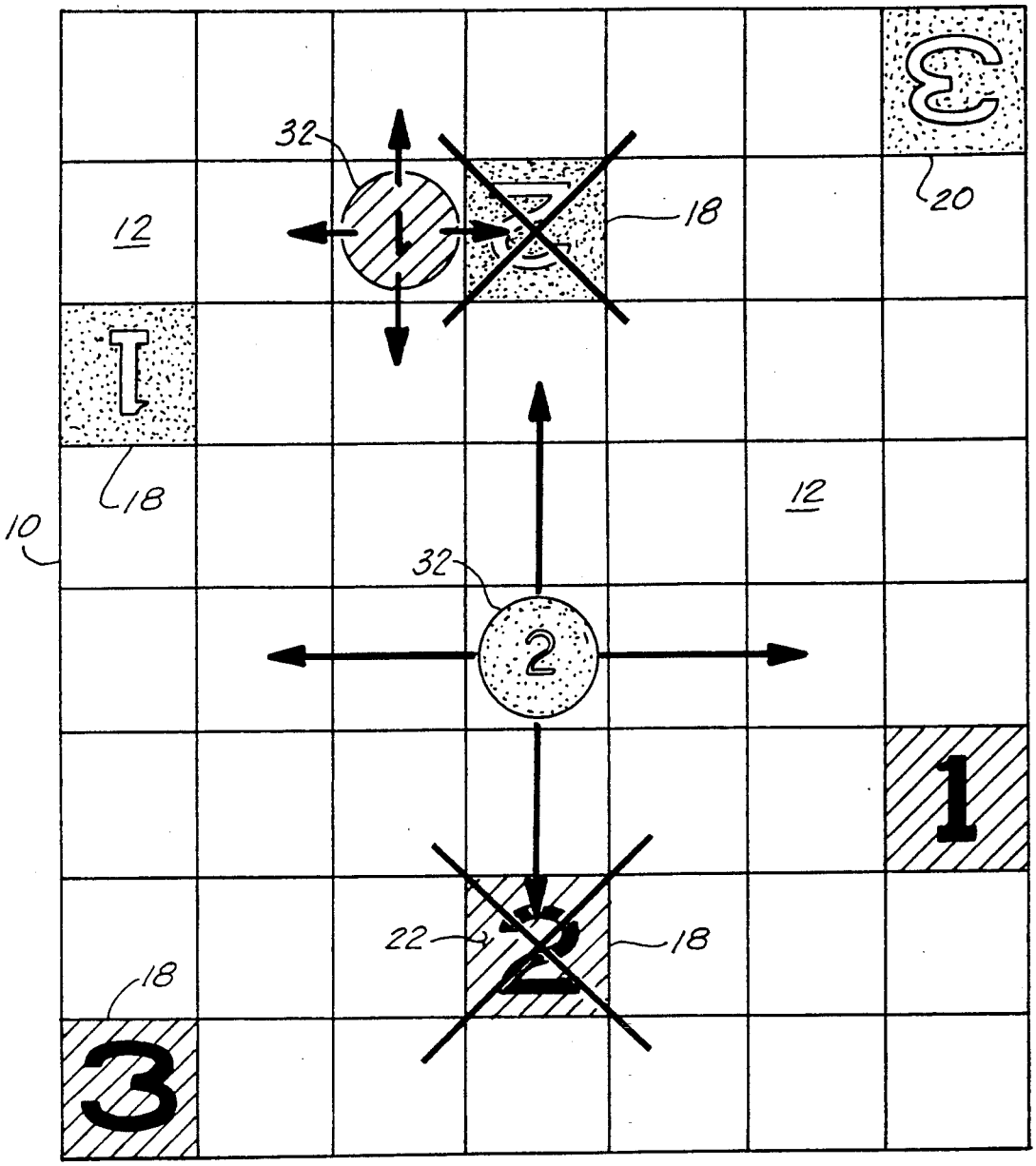
FIG. 3 is a plan view of selected playing pieces in which their direction and distance of movement is illustrated. Also.
Figure 4:
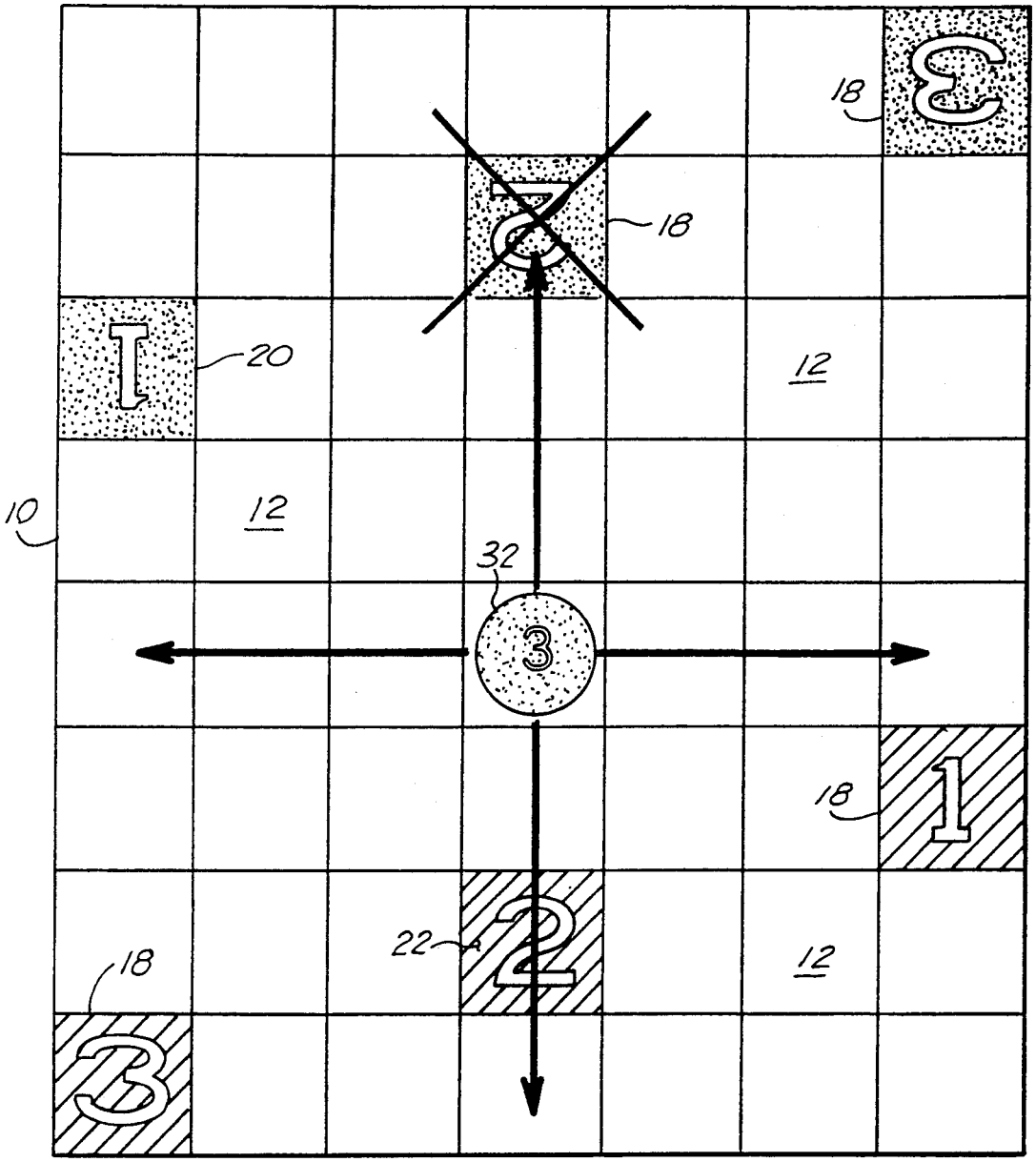
FIG. 4 is a plan view of a selected playing piece in which its direction and distance of movement is illustrated. Also.

FIGS. 3 and 4 illustrate the permissible moves of playing pieces 32 and those moves which are not permissible. FIG. 3 illustrates these moves with respect to playing pieces 32 marked with a value of "A" and "B" ("1" and "2"), while FIG. 4 illustrates these moves with respect to playing pieces 32 marked with a value of "C" ("3"). As shown, playing pieces 32 marked with a value of "A" can only move "A" spaces 12 upon board 10 either forward, backward or sideways, but not diagonally. Similarly, playing pieces 32 marked with a value of "B" or "C" can also only move "B" or "C" spaces 12 upon board 10 either forward, backward, or sideways but not diagonally. However, no playing piece 32 is permitted to land upon a safety zone 18 which does not correspond both with its shading or marking and its value.

Thus, as illustrated in FIGS. 3 and 4, a playing piece 32 belonging to one player cannot land upon any of the safety zones 18 associated with the other player. Additionally, a playing piece 32 of one value cannot land upon a safety zone 18 which is marked with a different value. Once a playing piece 32 of the proper value and shading lands upon its associated safety zone 18, this playing piece 32 can either remain there for the duration of play or it can be moved from this safety zone 18 as desired. Caution should be taken when moving from such a safety zone 18, however, since this playing piece 32 then becomes subject to capture by the opponent. While a playing piece 32 remains upon its associated safety zone 18, this playing piece 32 is not subject to capture.

Furthermore, no playing piece 32 is permitted to move partially in one direction and then complete its move in another direction. Instead, a playing piece can move in only one direction per play.

Figure 8:
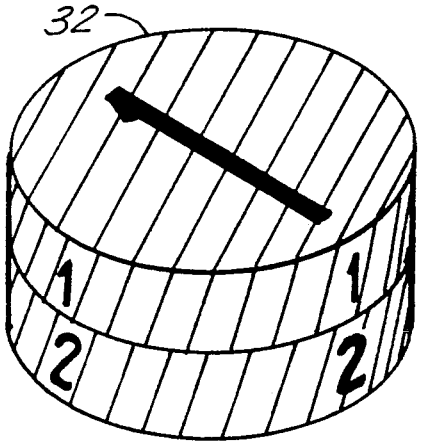
FIGS. 8-10 illustrate typical "stacking" arrangements of the playing pieces that can be accomplished during play.
Figure 9:
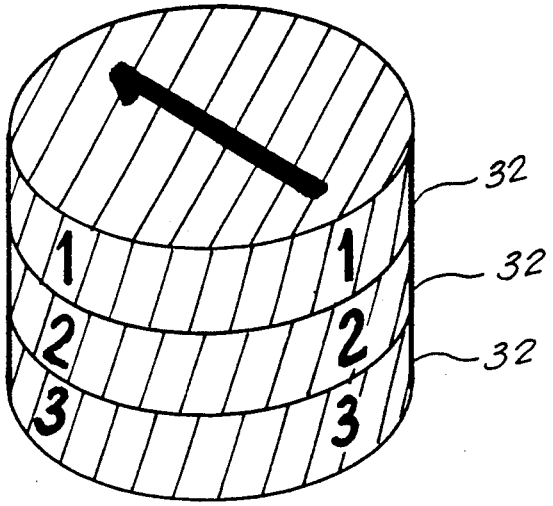
Figure 10:
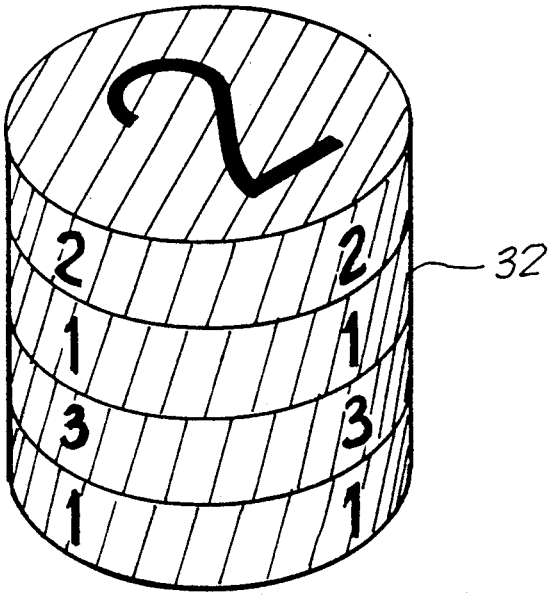

FIGS. 8-10 illustrate the "stacking" of playing pieces 32 provided for by this game. For example, these figures illustrate how playing pieces 32 of different values can be moved or stacked one atop the other to result in a new playing piece of a different value. As a result of such stacking, the combined playing pieces are moved about game board 10 a distance equal to the sum of these individual playing pieces 32. Furthermore, these newly combined playing pieces can be unstacked as needed but only from the top, i.e. only the top playing piece 32 can be unstacked or all but the bottom playing piece 32 can be unstacked or any combination in between. In FIG. 8, the new value of the combined playing pieces is "3"; in FIG. 9, the new value of the combined playing pieces is "6"; and in FIG. 10, the new value of the combined playing pieces is "7". Of course, only playing pieces 32 of the same color can be stacked one atop the other and such stacking occurs only by moving onto a square already occupied by a similarly colored playing piece 32. For example, referring to FIG. 2, one of the playing pieces 32 marked with a value of "1" could, on the first move of play, move backward to land upon a playing piece marked with a value of "2". For the next move of this player, this combined playing piece 32 could then be moved three spaces forward or to the side or this playing piece 32 marked with a value of "1" could be moved backward again onto a playing piece marked with a value of "3".

It should again be emphasized that stacking and unstacking occurs from the top only. For example, referring to FIG. 10, either the entire combination is moved or all but the bottom playing piece is moved or all but the bottom two playing pieces are moved, and so on. In no event are middle or bottom playing pieces 32 permitted to move without those already stacked upon it (e.g. in FIG. 10, the playing piece 32 marked with a value of "3" is not permitted to move unless the upper two playing pieces 32 are also moved. Additionally, during such movement, the orientation of the stacked playing pieces 32 are not permitted to change.

Figure 11:
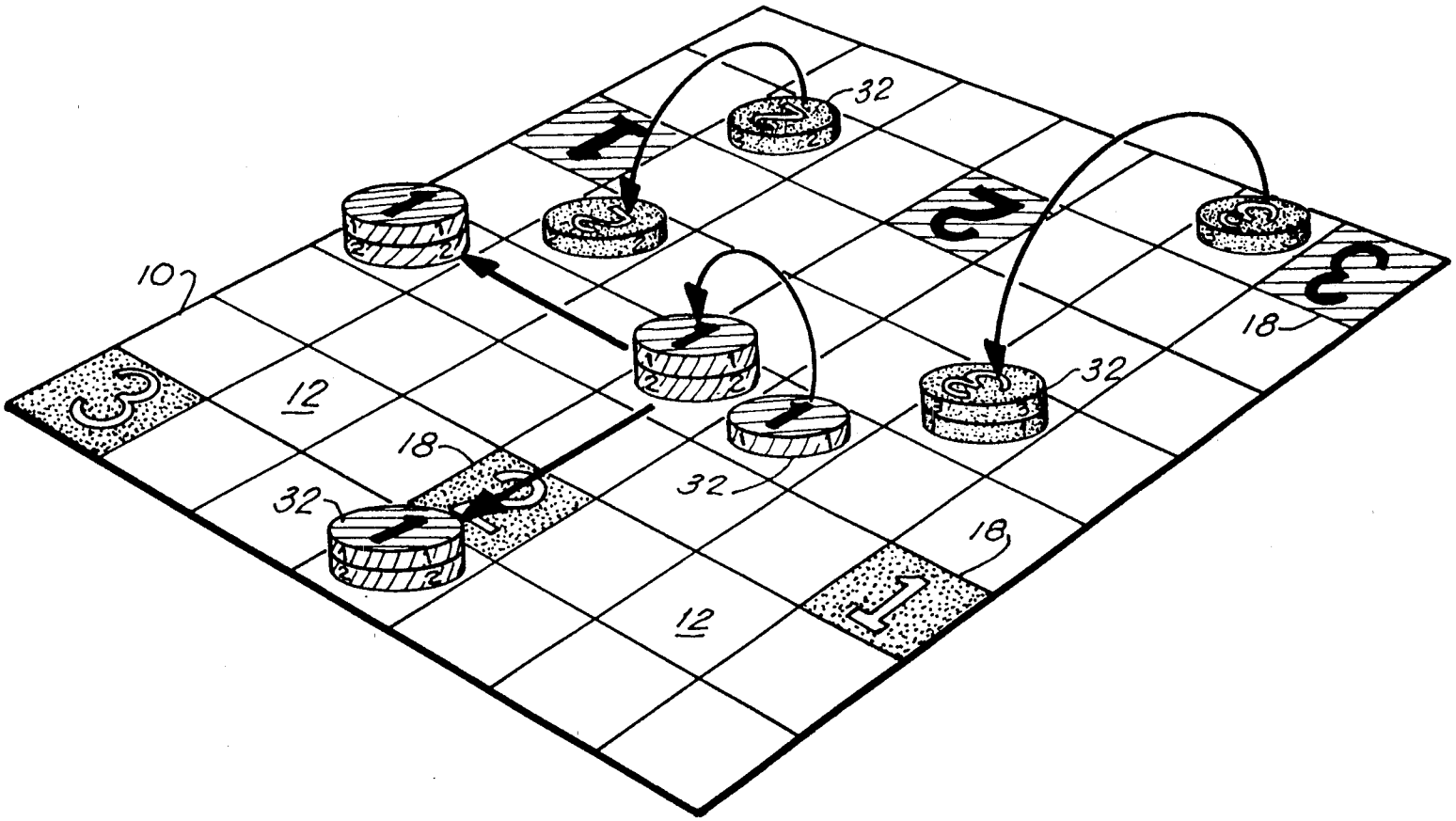
FIG. 11 illustrates sample moves of the various playing pieces.

FIG. 11 illustrates some typical moves which include the ability to stack one playing piece 32 upon another. For example, the dark playing piece marked with a value of "3" can be moved onto a space 12 already occupied by a similarly shaded playing piece marked with a value of "1" to result in a playing piece which can now move four spaces 12 if so desired. Another example pertains to a lightly colored playing piece 32 marked with a value of "1". In this example, this playing piece 32 can be moved onto a space 12 already occupied by a similarly colored playing piece 32 marked with a value of "2". The resultant combined playing piece can then move three spaces either forward, backward, or sideways as shown. (Of course, While a safety zone 18 cannot be landed upon except as stated above, such safety zone 18 is still counted when determining the movement of the various playing pieces 32.)

During play, it is possible to capture a playing piece 32 belonging to the opponent so long as this playing piece 32 is not located upon a safety zone 18. Capture occurs by simply landing upon a space 12 already occupied by a playing piece 32 belonging to the opponent. When such capture occurs, the captured playing piece 32 (whether a single unit or a stacked unit) is removed from board 10 and from further play. Jumping a playing piece 32 belonging to the opponent does not qualify as a capture.

To win the game, a player must land and retain a playing pieces 32 upon all of his/her safety zones 18. The first player to do so wins the game. A draw occurs if a player loses all of the playing pieces 32 of a certain value before this player can land such a playing piece 32 upon its associated safety zone 18. Should this occur, then this player is prevented from ever landing such a playing piece 32 upon its safety zone 18.

Figure 12:
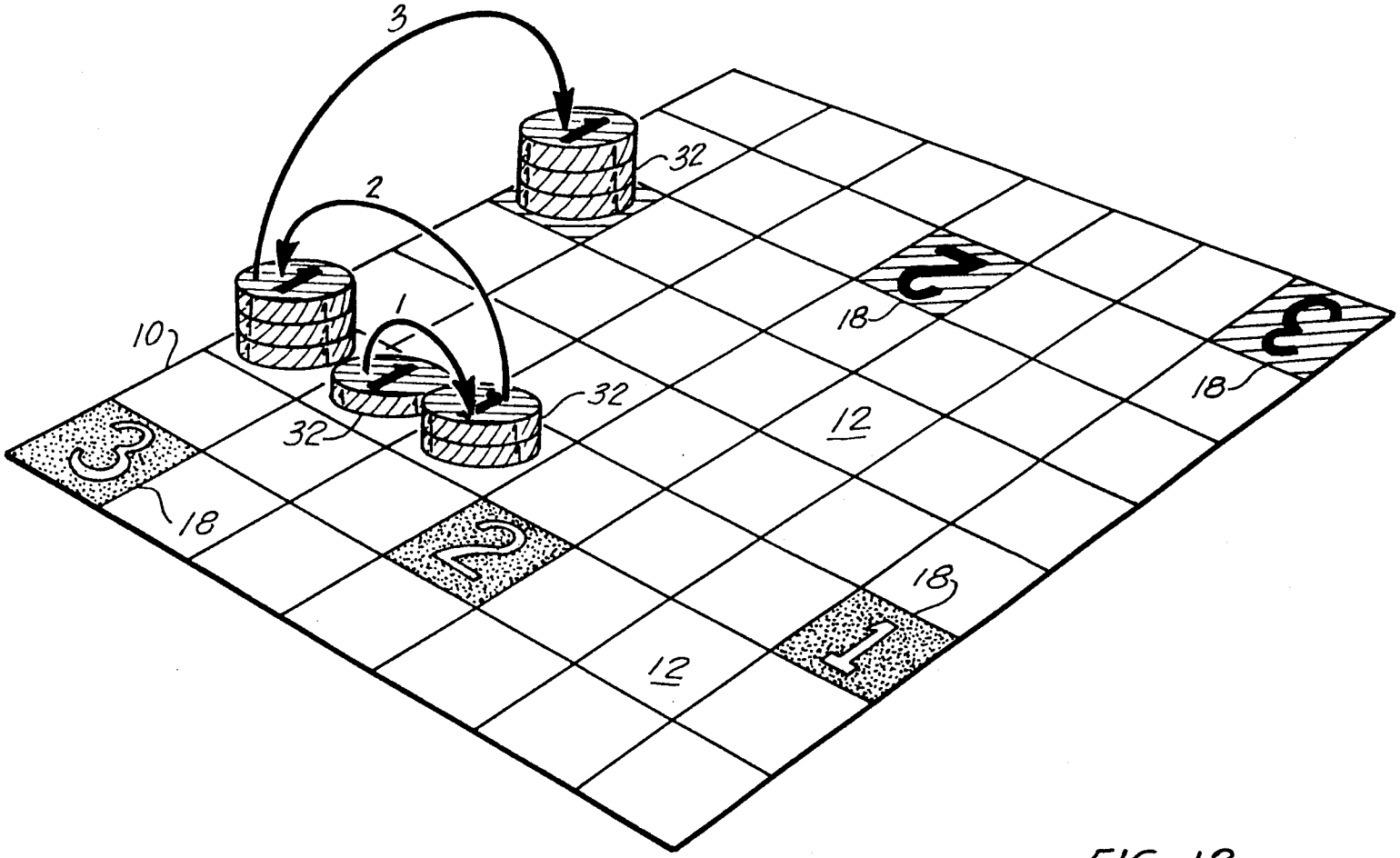
FIG. 12 illustrates how the playing pieces can become "stacked" during play and the subsequent distance such "stacked" pieces can move.

FIG. 12 illustrates a typical set of moves that can be made to land a playing piece 32 of a particular value upon its safety zone 18. These moves can be made when the playing pieces 32 are organized as shown in FIG. 2 at the beginning of play. Those playing pieces 32 not being so utilized are not shown for clarity. The moves are as follows:

(1) a playing piece 32 having a value of "1" is initially moved sideways onto its next adjacent playing piece 32 thereby stacking the two together., (2) this stacked or combined playing piece 32 is moved two spaces 12 sideways onto a third playing piece 32 of the same value; and, (3) this newly stacked playing piece 32 is then moved three spaces forward to subsequently land upon its associated safety zone 18.

Afterwards, this player may either leave these playing pieces 32 within this safety zone 18 or these playing pieces 32 may be unstacked from safety zone 18. If all of these playing pieces 32 are moved off of safety zone 18, they become subject to capture, thus the removal of the third or bottommost playing piece 32 from safety zone 18 should be done with extreme caution.

Figure 13:
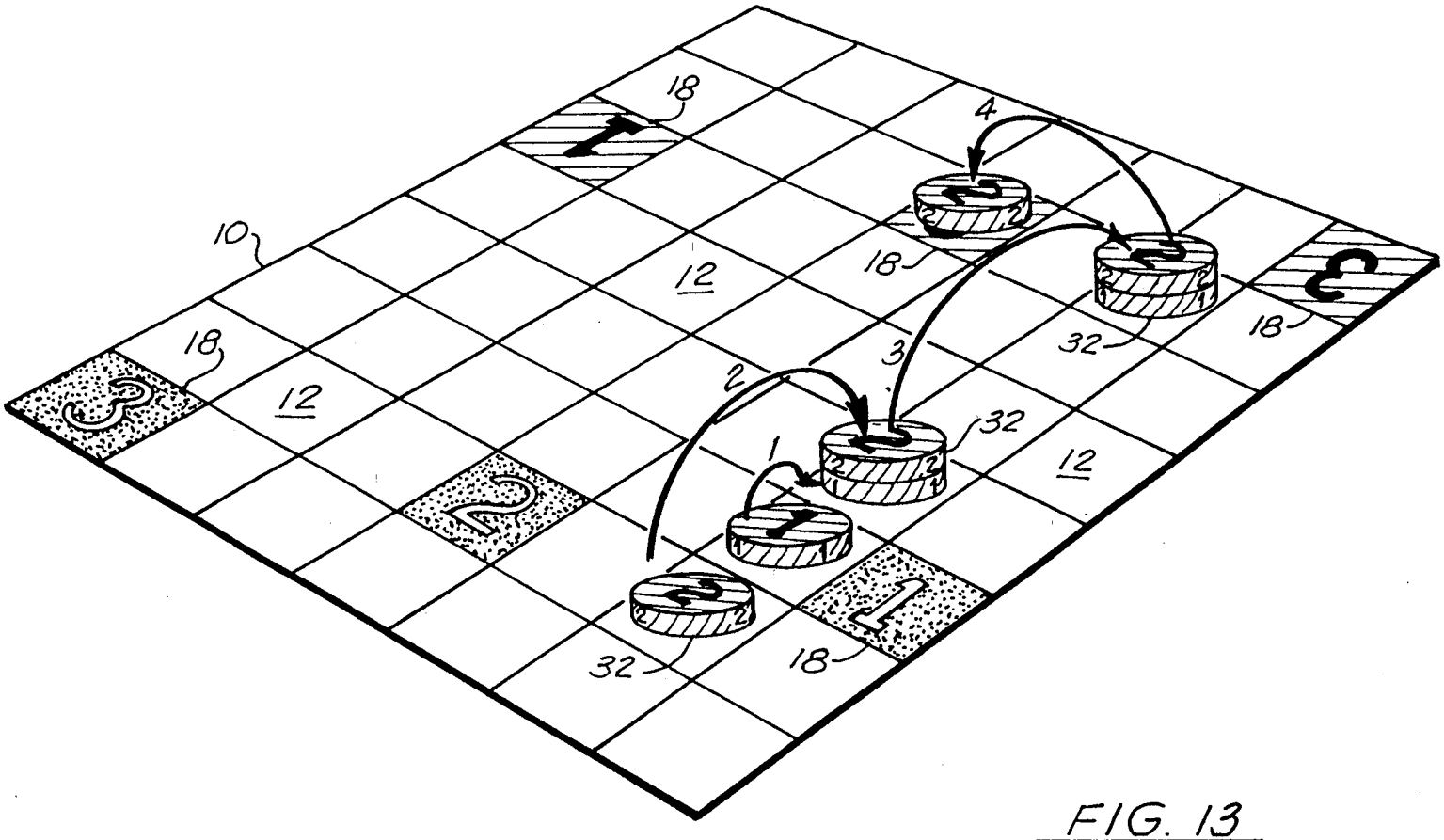
FIG. 13 illustrates one example of how a certain marked playing piece can be maneuvered onto its specially marked space on the playing board by incorporating both "stacking" and "unstacking" moves sequentially.

FIG. 13 illustrates another typical set of moves to land a playing piece 32 having a value of "2" upon its associated safety zone 18. These moves are as follows:

(1) a playing piece 32 having a value of "1" is moved one space 12 forward as shown., (2) a playing piece 32 having a value of "2" is moved onto this earlier moved playing piece 32;

(3) this stacked playing piece 32 is moved as a unit three spaces forward (thereby also capturing any playing piece 32 belonging to the opponent that happens to be on that space 12); and, (4) this stacked playing piece 32 is unstacked whereby the top playing piece 32 having a value of "2" is moved onto its associated safety zone 18 as shown.

Figure 14:
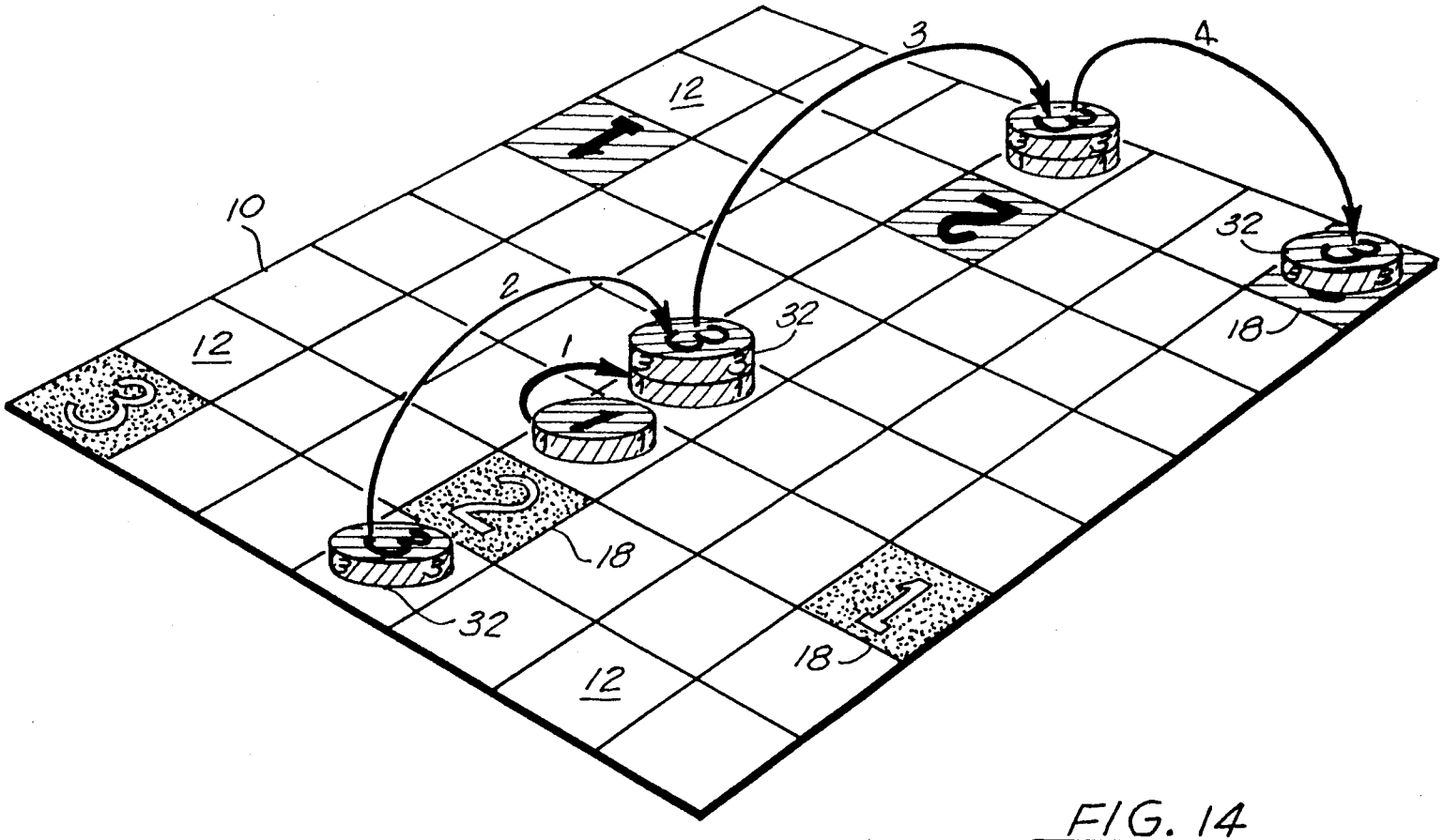
FIG. 14 illustrates another example of how a certain marked playing piece can be maneuvered onto its specially marked space on the playing board by incorporating both "stacking" and "unstacking" moves sequentially.

FIG. 14 illustrates a typical set of moves whereby a playing piece 32 having a value of "3" is moved onto its associated safety zone 18. Again, the initial set-up of these playing pieces is as shown in FIG. 2 at the beginning of play, those playing pieces 32 not involved are not shown for clarity. This set of moves is as follows:

(1) a playing piece having a value of "1" is moved one space 12 forward;

(2) a playing piece having a value of "3" is moved onto this previously moved playing piece 32 to create a stack;

(3) this stacked playing piece 32 is moved four spaces forward (thereby also capturing any playing piece 32 belonging to the opponent which happens to already be occupying this space 12); and, (4) the uppermost playing piece 32 having a value of "3" is unstacked and moved onto its associated safety zone 18.

Figure 15:
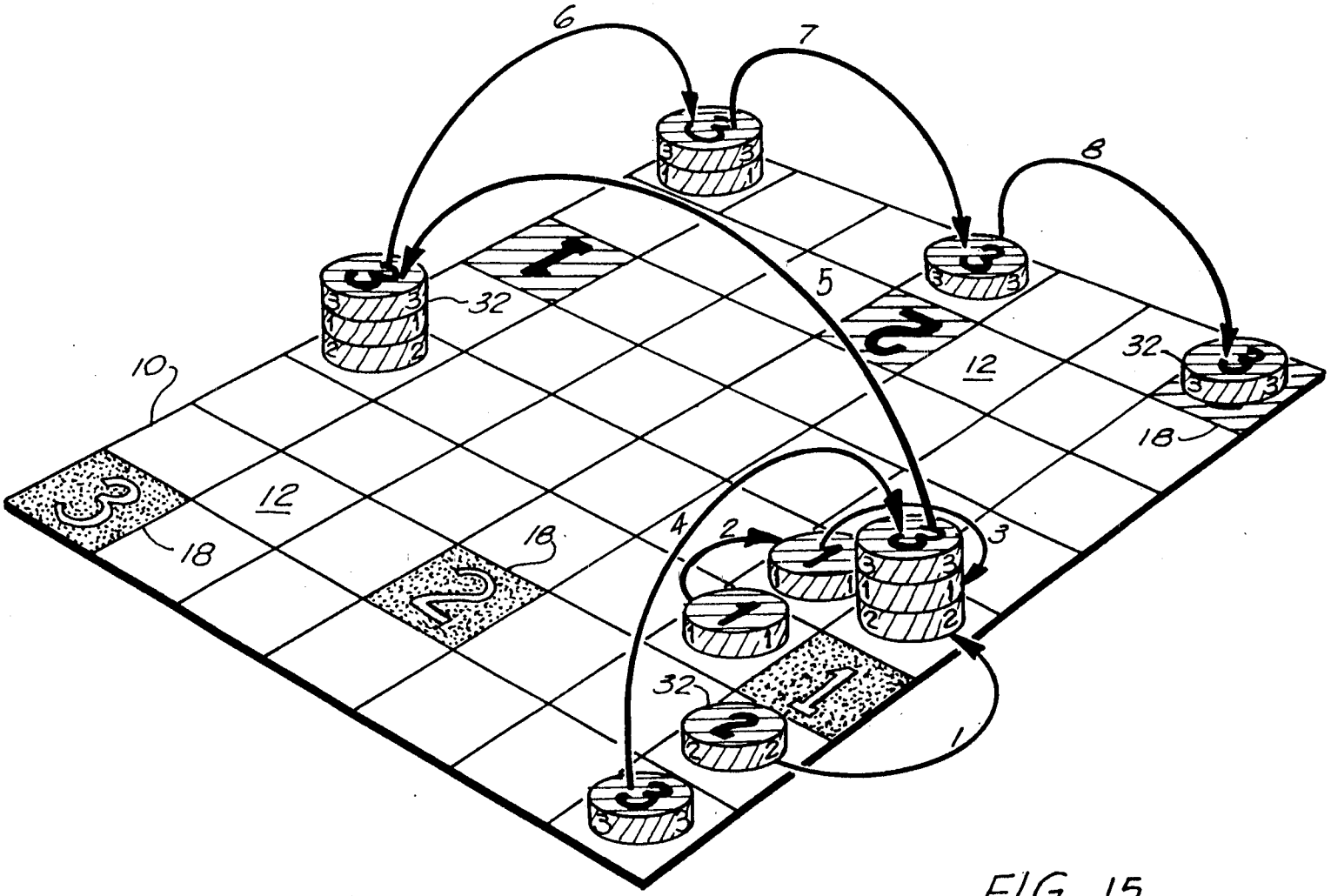
FIG. 15 illustrates yet another example of how a certain marked playing piece can be maneuvered onto its specially marked space on the playing board by incorporating both "stacking" and "unstacking" moves; and, FIG. 16 illustrates yet another example of how a certain marked playing piece can be maneuvered onto its specially marked space on the playing board by incorporating both "stacking" and "unstacking" moves.

FIG. 15 illustrates a more complicated set of offensive moves to place a playing piece 32 having a value of "3" onto its associated safety zone 18. These moves are as follows:

(1) a playing piece 32 having a value of "2" is moved two spaces forward;

(2) a playing piece 32 having a value of "1" is moved one space forward;

(3) this same playing piece 32 having a value of "1" is moved one space sideways to stack upon the previously moved playing piece 32 having a value of "2";

(4) a playing piece 32 having a value of "3" is moved three spaces forward to stack upon the previously stacked playing pieces 32;

(5) this stacked playing piece spaces 12 sideways;

(6) the upper two playing pieces 32 having a value of "3" and "1" are unstacked and moved four spaces 12 forward (thereby also capturing any playing piece 32 of the opponents' that happens to occupy that space 12);

(7) this stacked playing piece is further unstacked by moving the top playing piece 32 having a value of "3" three spaces sideways (thereby also capturing any playing piece 32 also on that space 12); and, (8) this playing piece 32 is again moved three spaces sideways to land upon its associated safety zone 18.

Figure 16:
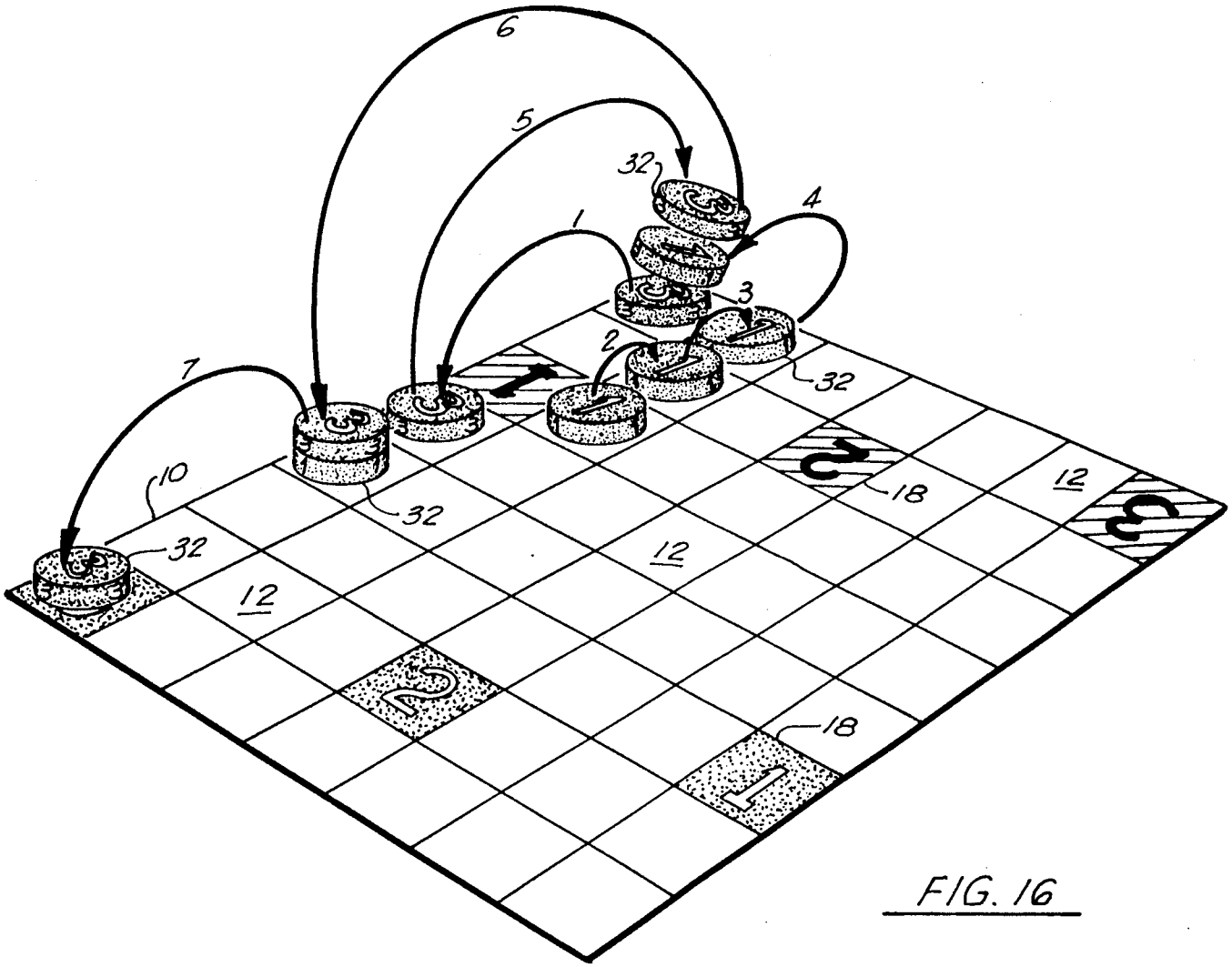

FIG. 16 illustrates a possible set of moves that can be made when the playing board 10 is not set up or organized as set forth in FIG. 2 at the beginning of play. In this case, play has already occurred with the required spaces 12 open for movement. In this case, the set of moves are as follows:

(1) a playing piece 32 having a value of "3" is moved three spaced forward;

(2) a playing piece 32 having a value of "1" is moved one space backward;

(3) this playing piece 32 having a value of "1" is again moved one space backward;

(4) this playing piece 32 having a value of "1" is moved one space sideways to land upon the space 12 previously occupied by the playing piece having a value of "3";

(5) the previously moved played piece 32 having a value of "3" is moved back to its original space 12 now occupied by the playing piece 32 having a value of "1" to create a stack;

(6) this stack is moved four spaces forward; and, (7) the top playing piece 32 having a value of "3" is unstacked and moved three spaces forward to land upon its associated safety zone 18.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A board game for two players comprising:

(a) a flat, generally rectangular game board having a grid of generally orthogonal lines thereon, thereby defining a series of adjacent rows and columns each of which are comprised of a plurality of contiguous individual spaces grouped by boundaries into a plurality of different zones including home zones at opposite ends of said grid and safety zones within said home zones;

(b) said safety zones being marked or shaded and located on said game board within said home zones with each said safety zone having a particular value assigned thereto, said game board comprising an equal number of safety zones associated with each player with the said safety zones associated with one player being shaded or marked differently from the said safety zones associated with the other player;

(c) a plurality of playing pieces each marked or shaded to distinguish those of one player from those of the other player and also marked or shaded similar to said safety zones of that player, each of said playing piece also being assigned a value identical to each one of the values assigned to the said safety zones;

(d) said playing pieces being movable, in turn, in a forward, backward, or sideways direction, on said game board only that number of said spaces identical with the value assigned thereto;

(e) said playing pieces of similar marking or shading being stackable one upon another by said forward, backward or sideways movement thereof, such said movement being referred to as "stacking" or "stacked", with said now stacked playing pieces having a value associated therewith equal to the sum of the values of the individual said playing pieces stacked together and thus said stacked playing pieces now being movable in a forward, backward or sideways direction about said game board with this new value;

(f) said stacked playing pieces being selectively unstackable by removing, from the top, as many of said playing pieces as desired, such said movement being referred to as "unstacking" or "unstacked", said unstacked playing pieces being movable about said game board in a forward, backward or sideways direction a number of said spaces equal to the sum of the individual values of said unstacked playing pieces;

(g) during play, a playing piece of one player, whether stacked or unstacked, being movable in said directions onto the same said space occupied by a playing piece of another player, whether stacked or unstacked, and when this occurs, the last arriving said playing piece "captures" the first arriving said playing piece and removes this first arriving said playing piece from further play; and, (h) whereby a "win" occurs when a player lands and retains his said playing piece on each of said safety zones associated with that player, said safety zones only permitting the movement thereon of playing pieces having both the same shading or marking and the same value.

2. The apparatus as set forth in claim 1, wherein there are a plurality of safety zones associated with each player.

3. The apparatus as set forth in claim 2, wherein each said safety zone is located in a different row upon said game board.

4. The apparatus as set forth in claim 3, wherein said safety zones of one player are located in the home zone of said game board associated with the other player.

5. The apparatus as set forth in claim 4, wherein one or more said particular values assigned to said safety zones are different integers.

6. The apparatus as set forth in claim 5, wherein said particular values assigned to said safety zones are "1", "2", and "3".

7. A method of playing a board game comprising the steps of:

(a) constructing and arranging a flat, generally rectangular game board with a grid of generally orthogonal lines thereon thereby defining a series of adjacent rows and columns each of which are comprised of a plurality of individual spaces;

(b) marking or shading safety zones on said game board with each said safety zone having a particular value assigned thereto, said game board comprising an equal number of safety zones associated with each player with the said safety zones associated with one player being shaded or marked differently from the said safety zones associated with another player;

(c) marking or shading a plurality of playing pieces so as to distinguish those of one player from those of another player and also marking or shading said playing pieces similar to the said safety zones of that player, each said playing piece also being assigned a value identical to one of the values assigned to the said safety zones;

(d) moving a said playing piece, in turn, on said game board only that number of said spaces identical with the value assigned thereto in a forward, backward, or sideways direction;

(e) stacking said playing pieces of similar marking or shading upon another, such said movement being referred to as "stacking" or "stacked", with said now stacked playing pieces having a value associated therewith equal to the sum of the values of the individual said playing pieces stacked together and thus said stacked playing pieces now being movable about said game board with this new value;

(f) selectively unstacking said stacked playing pieces by removing, from the top, as many said playing pieces as desired, such said movement being referred to as "unstacking" or "unstacked", said unstacked playing pieces now being movable about said game board a number of said spaces equal to the sum of the individual values of the said unstacked playing pieces;

(g) capturing a said playing piece associated with the other player by moving a said playing piece associated with a first player onto the same said space occupied by a said playing piece associated with the other player, said playing pieces, whether the capturing playing piece or the captured playing piece, being either stacked or unstacked, when such movement occurs, the last arriving said playing piece "captures" the first arriving said playing piece and removes this first arriving said playing piece from further play; and, (h) winning the game by being the first player to move and retain a said playing piece on each of the said safety zones associated with that player, said safety zones only permitting the movement thereon of playing pieces having both the same shading or marking and the same value.

8. The method as set forth in claim 7 further comprising the step of constructing and arranging said game board for two players.

9. The method as set forth in claim 8 further comprising the step of marking or shading a total os six said safety zones upon said game board, three said safety zones being associated with each said player.

10. The method as set forth in claim 9 further comprising the step of locating said safety zones in different rows upon said game board.

11. The method as set forth in claim 10, wherein said spaces are grouped by boundaries into a plurality of different zones including home zones at opposite ends of said grid and said safety zones within said home zones, and further comprising the step of locating said safety zones of one player in the home zone of said game board associated with the other player.

12. The method as set forth in claim 11 further comprising the step of assigning a value to said safety zones wherein one or more said values are different integers.

13. The method as set forth in claim 12 further comprising the step of assigning a value of either "1", "2", or "3" to said safety zones.

* * * * *